US005554019A

United States Patent [19]

Hodge

[11] Patent Number: 5,554,019

[45] Date of Patent: Sep. 10, 1996

[54] COMPACT GEROTOR PUMP

[75] Inventor: Steve Hodge, Tamworth, United Kingdom

[73] Assignee: Concentric Pumps Limited, Birmingham, Great Britain

[21] Appl. No.: 374,585

[22] PCT Filed: Aug. 9, 1993

[86] PCT No.: PCT/GB93/01680

§ 371 Date: Jan. 24, 1995

§ 102(e) Date: Jan. 24, 1995

[87] PCT Pub. No.: WO94/04824

PCT Pub. Date: Mar. 3, 1994

[30] Foreign Application Priority Data

Aug. 18, 1992 [GB] United Kingdom ..... 9217540

[51] Int. Cl.[6] ..... F04C 2/10

[52] U.S. Cl. ..... 418/171

[58] Field of Search ..... 418/166, 170, 418/171; 417/356

[56] References Cited

U.S. PATENT DOCUMENTS 5,261,803 11/1993 Freeman ..... 418/171

FOREIGN PATENT DOCUMENTS 0361716 4/1990 European Pat. Off. .
0517014 12/1992 European Pat. Off. .

*Primary Examiner*—John J. Vrablik
*Attorney, Agent, or Firm*—Learman & McCulloch

[57] ABSTRACT

A compact gerotor pump having reduced axial dimension has an external fixed pump body in which a rotor and annulus set is housed. A drive shaft is provided that is neither fixed nor journalled directly by the pump body. The shaft is secured to the rotor within the body and extends through an opening in an end wall of the body and is secured to the hub of an external drive gear that is journalled by the housing for driven rotation of the drive gear, shaft, and rotor relative to the pump body.

11 Claims, 1 Drawing Sheet

COMPACT GEROTOR PUMP

This invention relates to gerotor pumps which, as well known, comprise a male lobed rotor with n lobes, located in and meshed with a female lobed annulus having n+1 lobes. This rotor and annulus, called the gerotor set, rotate relative to one another about parallel axes so that a series of chambers each defined between a pair of parallel lines of contact between the two parts rotate about said axes, increase in size as they pass over an inlet port in a first half revolution, and decrease in size as they pass over an outlet port in the following half revolution. The ports are formed in a body having a cylindrical cavity for the gerotor set.

BACKGROUND OF THE INVENTION

Many different designs of gerotor pump are known: the objects of the present invention are to simplify manufacture and particularly to provide for axial compactness, without sacrificing efficiency or durability.

SUMMARY OF THE INVENTION

According to the invention, a gerotor pump is characterised by an externally at least part-cylindrical body, a drive gear journalled on said body part and angularly fast with a drive shaft concentric of the body, said shaft also being angularly fast with the rotor of the gerotor set.

Preferably the shaft is a clearance fit in the body of the pump, that is, it does not make contact with the body at any point. Hence the pump of the invention is distinguished from the prior art in that the shaft is neither fast with the body (as has previously been suggested in certain prior art patents) nor is it journalled in the body, which has been the norm in pumps of this kind. When the shaft is fast with the body, it is necessary to provide a certain body length which can support the shaft in cantilever fashion, and when the shaft is journalled in the body an even greater axial length has to be provided to support the shaft. By supporting the shaft from the drive gear, with which it is fast and journalling the gear, reduced axial dimensions are possible without any sacrifice of pump performance.

The axial length of the shaft is equal to the sum of the axial length of the rotor, the axial thickness of the drive gear and its hub, i.e. in the region of the shaft, and the dimension between the two parts, if any.

The pump body may be cup-shaped with the base of the cup apertured for the shaft to extend through, and the rim of the cup may sit on an associated part such as the face of an engine block or sump. Or the rim of the cup may be associated with a closure plate. The shaft may extend up to that block, sump or plate with a slight end clearance for the shaft.

The shaft may be an interference fit in both rotor and drive gear, or alternatively it may be splined to one or the other to allow for removal for maintenance purposes.

The engineer to whom this specification is addressed will understand that the shaft requires to run true, and its cantilever stiffness is dictated by the journalling of the gear together with the connection between the shaft and the gear.

THE DRAWINGS

In the accompanying drawings, two pumps are illustrated in FIGS. 1 and 2, respectively, which are generally similar, both being shown in sectional elevation.

DETAILED DESCRIPTION

Figure 1:
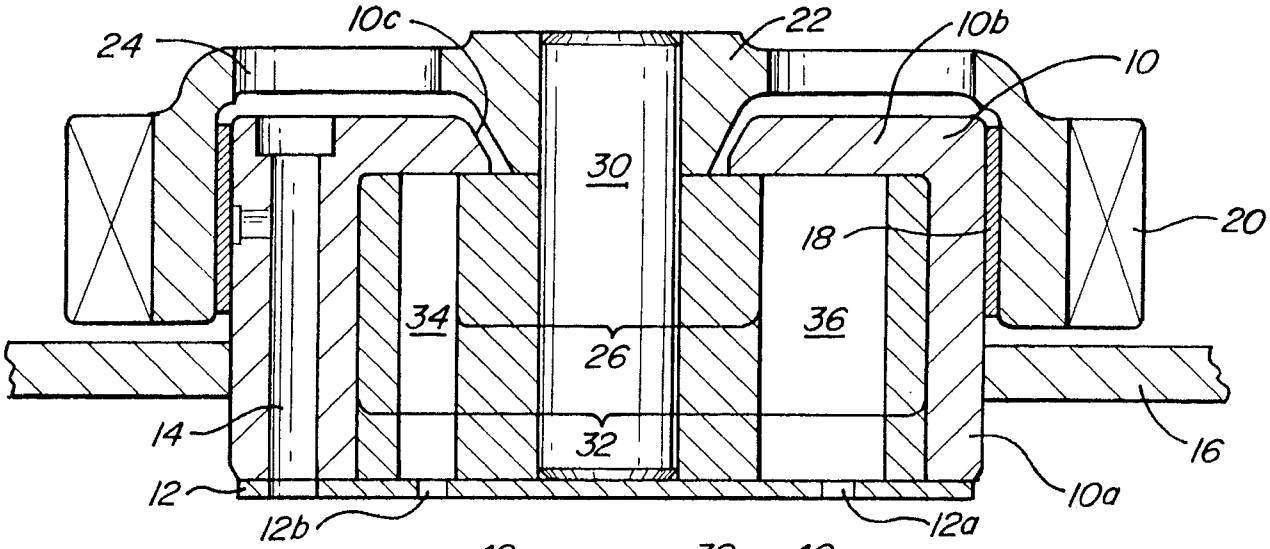

Turning first to FIG. 1, the body 10 is generally cup-shaped having a generally cylindrical side wall 10*a* and a transverse, generally planar end wall 10*b*, and secured to a closure plate 12 by means of cap screws located in spaced apertures 14. In this instance the pump is accommodated in an aperture in an engine component 16.

A bearing bush 18 is supported on the cylindrical exposed portion of the body wall and this journals drive gear 20. The gear is unitary with the hub 22 and there are apertures 24 in the gear to reduce weight and provide access to the cap screws.

It will be noted that the end wall 10*b* of the body 10 has an enlarged central opening 10*c* and the hub 22 extends into than opening 10*c* with a clearance between it and the body, and as such is neither contacted nor supported by the wall of the opening.

The rotor 26 is located in the body and has the same axial length as the cylindrical cavity therein. The rotor is fast with shaft 30 for example as an interference fit thereon. In this pump of FIG. 1, the drive gear is also fast with the shaft as an interference fit thereon. The rotor and hub abut one another. It will be appreciated that assembly is achieved by fitting the shaft one or other of gear and rotor, passing the remaining shaft portion through the body central opening and then pressing the shaft and other of the rotor and gear into interference fit assembly.

The gerotor set also comprises the annulus 32 which is of the same axial length as the rotor and is journalled in the body 10. Two of the chambers formed between the gerotor parts are indicated by the reference numerals 34 and 36, and these chambers open axially through the plate 12 to the inlet and outlet ports, shown at 12*a* and 12*b*, respectively. It will be appreciated that this provides an extremely axially compact pump.

Figure 2:
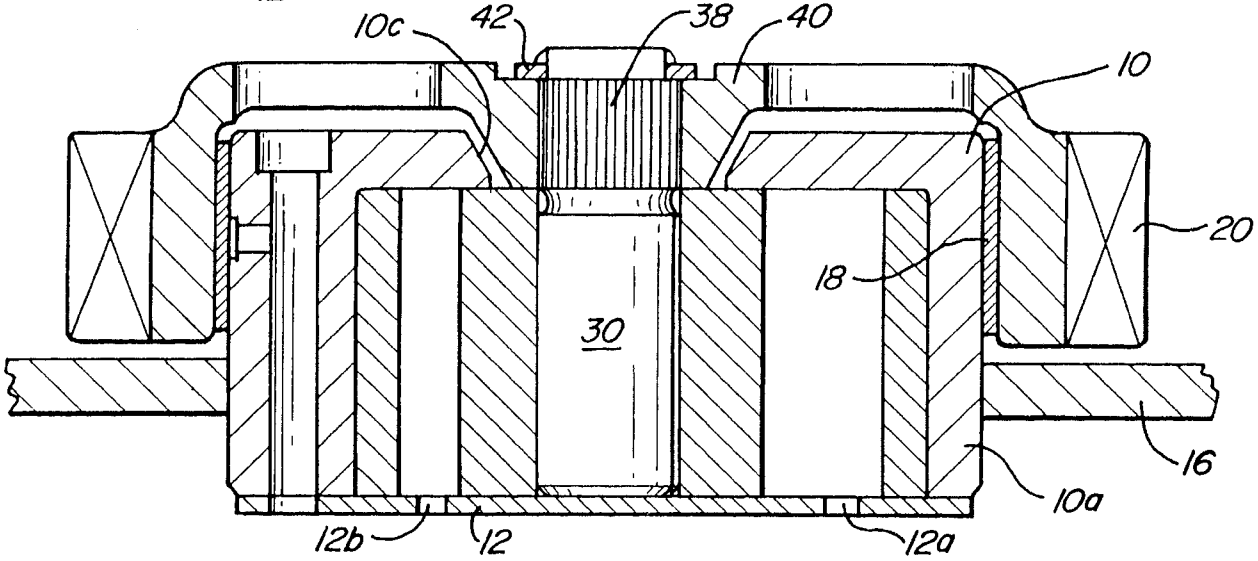

In the arrangement shown in FIG. 2 all of the parts are the same except that here the shaft has a splined portion 38 engaging in the hub 40 and the hub and shaft are held together against axial displacement on these splines by a circlip (RTM) 42. This enables the drive gear to be removed without dismantling the pump.

It will be seen that the cantilever loads, that is to say the maintenance of co-axiality and concentricity without tilt, are carried by the journal bearing length on the bush 18. Hitherto in the prior art, the equivalent length for carrying the cantilever load was that of the journal portion of the shaft which was essentially additional to the rotor length: here it is co-extant, thus substantially shortening the pump.

I claim:

1. A gerotor pump assembly comprising: an external body, a rotatable drive shaft, a rotor housed within said body and coupled to said shaft for rotation therewith, and a drive gear coupled to said drive shaft at one end, the other end of said drive shaft being unsupported, said drive gear being journaled by said body for drivingly rotating said shaft and said rotor relative to said body.

2. The assembly of claim 1 wherein said shaft is spaced radially from said body.

3. The assembly of claim 1 wherein said body has a generally cup-shaped configuration including a generally cylindrical side wall portion and a transverse end wall portion having a central opening therethrough, said drive gear having a hub portion overlying said end wall, and a portion of said shaft extending through said central opening in spaced unsupported relation to the wall of said opening and secured to said hub portion of said drive gear.

4. The assembly of claim 3 wherein the remaining portion of said shaft is accommodated within said body in spaced relation to said side wall of said body.

5. The assembly of claim 4 wherein said remaining portion is substantially coextensive with said rotor.

6. The assembly of claim 3 wherein said shaft is substantially coextensive in length with the combined height of said rotor and said hub portion of said drive gear.

7. The assembly of claim 3 wherein said shaft and said hub portion are joined with an interference fit to preclude relative rotation therebetween.

8. The assembly of claim 3 wherein said shaft and said hub are joined by a spline connection precluding relative rotation therebetween.

9. The assembly of claim 3 wherein said shaft and said rotor are joined with an interference fit to preclude relative rotation therebetween.

10. The assembly of claim 3 wherein said body has an open end opposite said end wall, said open end being closed by an associated end part having fluid inlet and outlet ports therein.

11. A gerotor pump assembly comprising: an exterior fixed body having a generally cylindrical side wall and a transverse end wall having a central opening therethrough; a rotatable drive shaft having a first portion thereof accommodated within said body in spaced unsupported relation to said side wall of said body and a remaining extending portion thereof projecting through said central opening to the exterior of said body in spaced unsupported relation to the end wall; a rotor and annulus set housed within said body, said rotor being mounted on said shaft for rotation therewith; and an external drive gear journaled by said body for driven rotation relative to said body and including a central hub portion overlying said end wall of said body, said extended portion of said drive shaft being secured to said hub portion of said drive gear thereby to support and drive said shaft and said rotor relative to said body and in turn rotate said annulus relative to said body.

* * * * *